US008517630B2

(12) United States Patent
Graham et al.

(10) Patent No.: US 8,517,630 B2
(45) Date of Patent: Aug. 27, 2013

(54) SCREED PLATE ARRANGEMENT AND METHOD OF ATTACHING A SCREED PLATE

(75) Inventors: Luke E. Graham, Maple Grove, MN (US); Jason W. Kopacz, St. Louis Park, MN (US); Tobin D. Rasmusson, Bloomington, MN (US); Timothy L. Wehrenberg, Maple Grove, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/312,587

(22) Filed: Dec. 6, 2011

(65) Prior Publication Data

US 2013/0142571 A1 Jun. 6, 2013

(51) Int. Cl.
*E01C 19/22* (2006.01)
*E01C 7/06* (2006.01)

(52) U.S. Cl.
USPC ..... 404/118; 404/77; 404/95

(58) Field of Classification Search
USPC ..... 404/118, 95, 77, 79
See application file for complete search history.

(56) References Cited

U.S. PATENT DOCUMENTS

| | | | | |
|---|---|---|---|---|
| 3,872,601 | A | 3/1975 | Burgin | |
| 5,088,854 | A | 2/1992 | Sovik | |
| 5,259,693 | A | 11/1993 | Raymond | |
| 5,308,190 | A * | 5/1994 | Raymond | 404/95 |
| 5,366,320 | A * | 11/1994 | Hanlon et al. | 404/118 |
| 5,397,199 | A | 3/1995 | Frampton et al. | |
| RE36,981 | E | 12/2000 | Birtchet | |
| 6,273,636 | B1 | 8/2001 | Johanpeter | |
| 6,318,928 | B1 | 11/2001 | Swearingen | |
| 6,963,050 | B2 | 11/2005 | Heindtel | |
| 6,981,820 | B2 | 1/2006 | Nelson | |
| 8,157,474 | B2 * | 4/2012 | Mahler et al. | 404/95 |
| 2001/0014212 | A1 * | 8/2001 | Rutherford | 392/503 |
| 2004/0086336 | A1 * | 5/2004 | Nelson | 404/72 |
| 2006/0045624 | A1 * | 3/2006 | Nelson | 404/95 |
| 2010/0310312 | A1 * | 12/2010 | Mahler et al. | 404/95 |
| 2011/0002737 | A1 * | 1/2011 | Mahler et al. | 404/118 |
| 2011/0002738 | A1 * | 1/2011 | Mahler et al. | 404/118 |
| 2011/0123269 | A1 * | 5/2011 | Lutz | 404/118 |

FOREIGN PATENT DOCUMENTS

| | | | |
|---|---|---|---|
| EP | 641887 | B1 | 7/1997 |

* cited by examiner

*Primary Examiner* — Thomas B Will
*Assistant Examiner* — Abigail A Risic
(74) *Attorney, Agent, or Firm* — Leydig, Voit & Mayer

(57) ABSTRACT

Asphalt paving machine includes screed assembly, plurality of lower and upper plate fasteners, and upper and lower screed plates, each having openings, and an electric heater at least partially disposed between the plates. Upper and lower plate fasteners extend into openings of the respective upper and lower screed plates and bores of a frame portion of the screed assembly to couple the plates to the frame portion. The upper plate fasteners couple the upper screed plate to the frame portion independently of the lower screed plate, so the lower plate is displaceable from the upper plate and the frame portion.

20 Claims, 5 Drawing Sheets

SCREED PLATE ARRANGEMENT AND METHOD OF ATTACHING A SCREED PLATE

TECHNICAL FIELD

The present disclosure relates to asphalt paving machines, and, more particularly, to a screed arrangement and a method of attaching a screed plate to a screed assembly.

BACKGROUND

Laying asphalt paving material on road surfaces entails spreading paving material consisting of an aggregate filled bituminous mixture on a prepared roadbed. The paving material is spread while hot and is then compacted so that a hardened pavement surface is formed upon cooling. Conventional paving machines utilize a heavy assembly termed a "screed" that is drawn behind the paving machine. The screed assembly includes a replaceable screed plate that is constructed of a suitable steel, to spread a smooth even layer of paving material on the prepared roadbed. The weight of the screed assembly aids in compressing the paving material and performing initial compaction of the paving material layer. Screed assemblies can include vibratory mechanisms placed directly on the screed plate or separate vibratory tamper bars connected in tandem with the screed plate to aid in the initial compaction of the paving material.

To facilitate laying of the paving material, the screed plate is typically heated, to a temperature in the range of about 82° to 171° C. (180° to 340° F.). Heating the screed plate assists the paving material in flowing under the screed plate and reduces adhesion of the paving material to the screed plate. If the screed plate is not adequately heated, the bituminous mixture contacting the bottom of the screed plate begins to harden, resulting in buildup of paving material and excessive drag.

Conventional screed plates are commonly heated by fossil fuel powered burners that heat the upper surface of the screed plate by the direct application of flame or hot exhaust gases. The use of fossil fuel burners to heat screed plates has several drawbacks. Combustion of fossil fuels generates smoke that represents a source of environmental pollution, and also poses a poor working environment for the paving workers. Additionally, because the flames or exhaust gases of the burners actually contact the screed surface, warping may result. The contour of the screed plate determines the quality, evenness and smoothness of the paving material that is being laid down. Screed plates are often flexed under extreme tensile loads during use to achieve desired crowning or other surface contours.

One alternate heating system that represents an improvement and which addresses the environmental drawbacks is disclosed in U.S. Pat. RE 36,981 issued Dec. 5, 2000 to Ralph Birtchet and assigned to Universal Screed Inc. Birtchet discloses the use of an elastomeric, electrically powered heating pad assembly positioned on the upper surface of the screed plate with a layer of insulation placed on top of the heating pad assembly. A heavy steel retainer plate assembly is disposed on top of the insulation to hold the heating pad assembly and the insulation in contact with the screed plate. But for the retainer plate assembly, the heating pad assembly and the layer of insulation are loosely positioned on the upper surface of the screed plate, mechanically constrained in their installed positions only by the forward face plate portion and the tail portion of the screed plate, and the side plates. The screed plate is attached directly to the deck plate of the paving machine.

Assembling the screed plate to the paving machine is generally a time consuming process because the screed plate must be precisely oriented relative to the frame. Assembly of the screed plate to the frame typically involves time consuming shimming operations. Inasmuch as the screed plate is a wear component, replacement due to wear may result in considerable downtime, often for days inasmuch as this shimming process must be repeated. Similar delays may result when the screed plate is removed to access the heating assembly for replacement or repair.

SUMMARY

The disclosure describes, in one aspect, an asphalt paving machine comprising a screed assembly, a screed plate assembly, at least two lower plate fasteners, and at least two upper plate fasteners. The screed assembly includes a screed supporting frame portion having at least two first bores and at least two second bores. The screed plate assembly includes at least one lower screed plate having at least two openings, at least one upper screed plate having at least two openings, and at least one electric heater at least partially disposed between the upper and lower screed plates. The lower plate fasteners extend into the at least two openings of the lower screed plate and the at least two first bores of the screed supporting frame portion to couple the lower screed plate to the screed supporting frame portion. The upper plate fasteners extend into the at least two openings of the upper screed plate and the at least two second bores of the screed supporting frame portion to couple the upper screed plate to the screed supporting frame portion independently of the lower screed plat. The lower plate is displaceable from the upper screed plate and the screed supporting frame portion by loosening the at least two lower plate fasteners.

The disclosure also describes, in one aspect, a screed plate assembly for attachment to a screed supporting frame portion of an asphalt paving machine. The screed supporting frame portion has at least two first bores and at least two second bores. The screed plate assembly includes at least one lower screed plate having at least two openings, at least one upper screed plate having at least two openings, at least one electric heater at least partially disposed between the upper and lower screed plates, at least two lower plate fasteners adapted to extend into the at least two openings of the lower screed plate and the at least two first bores of the screed supporting frame portion to couple the lower screed plate to the screed supporting frame portion, and at least two upper plate fasteners adapted to extend into the at least two openings of the upper screed plate and the at least two second bores of the screed supporting frame portion to couple the upper screed plate to the screed supporting frame portion independently of the lower screed plate. The lower plate is displaceable from the upper screed plate and the screed supporting frame portion by loosening the at least two lower plate fasteners.

The disclosure describes in another aspect a method of attaching a screed plate assembly to a screed assembly of an asphalt paving machine, wherein the screed assembly includes a screed supporting frame portion. The method includes providing at least two first bores and at least two second bores in the screed supporting frame portion, providing a screed plate assembly including at least one lower screed plate having at least two openings, at least one upper screed plate having at least two openings, and at least one electric heater disposed between the upper and lower screed plates, extending at least two upper plate fasteners into the at least two openings of the upper screed plate and the at least two second bores of the screed supporting frame portion to secure the upper screed plate to the screed supporting frame portion, and extending at least two lower plate fasteners into the at least two openings of the lower screed plate and the at least two first bores of the screed supporting frame portion to secure the lower screed plate to the screed supporting frame portion, the at least two upper plate fasteners securing the upper screed plate to the screed supporting frame portion independently of the lower screed plate.

BRIEF DESCRIPTION OF THE DRAWING(S)

DETAILED DESCRIPTION

Figure 1:
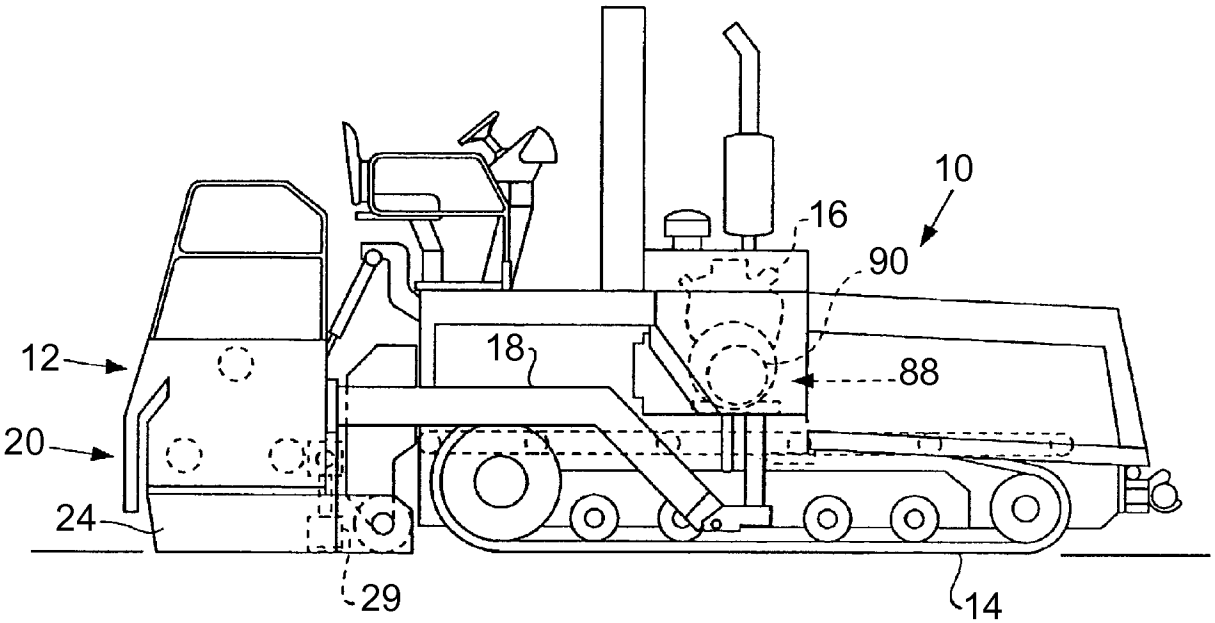
FIG. 1 is a diagrammatic side view of an asphalt paving machine towing a screed assembly embodying the present invention.

This disclosure relates to a design and mounting arrangement for coupling a screed plate to a screed assembly 12 of an asphalt paving machine 10, as shown in FIG. 1. The asphalt paving machine 10 is supported by a propelling arrangement 14 that is driven by an engine 16 in a conventional manner.

Figure 2:
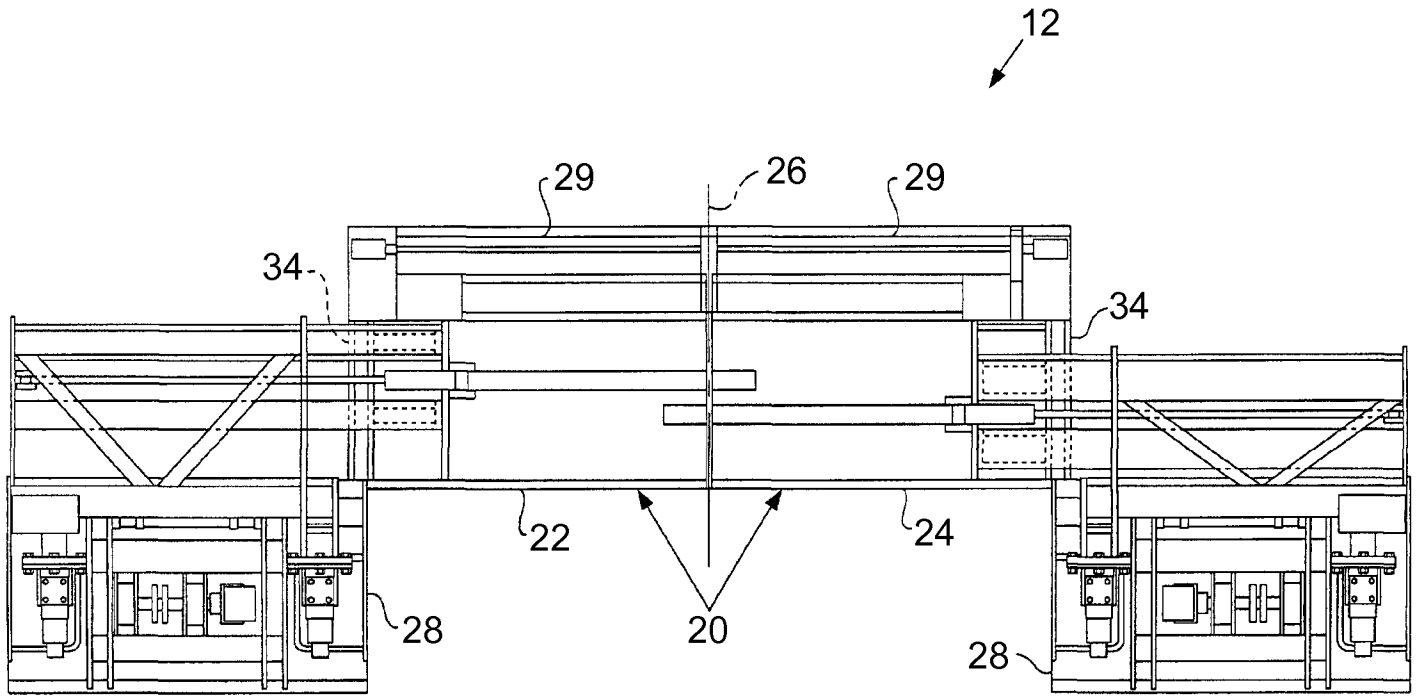
FIG. 2 is a plan view of the screed assembly shown in FIG. 1.

The screed assembly 12 is pivotally connected behind the asphalt paving machine 10 by tow arms 18. The screed assembly 12 may be any of a number of configurations such as a fixed width screed or a multiple section screed that includes extensions. As shown in FIG. 2, the screed assembly 12 may be provided with a main screed section 20 with a left and a right screed section 22, 24. The left and right screed sections 22, 24 are hingably connected to one another along a longitudinal centerline 26 so that various operations, such as crowning, can be performed. A screed extension 28 is provided behind and adjacent to each of the left and right screed sections 22, 24, although the screed extensions 28 may be positioned in front of the main screed section 20. The screed extensions 28 are slidably movable, such as by actuators (not shown), so that varying widths of paving material can be laid. The screed assembly 12 may also include a tamper bar arrangement 29 positioned forward of the main screed section 20, as shown in FIGS. 1 and 2, and/or a vibratory mechanism 21 positioned above the left and right screed sections 22, 24 and the screed extensions 28 to aid in the initial compaction of the paving material being laid down.

Figure 3:
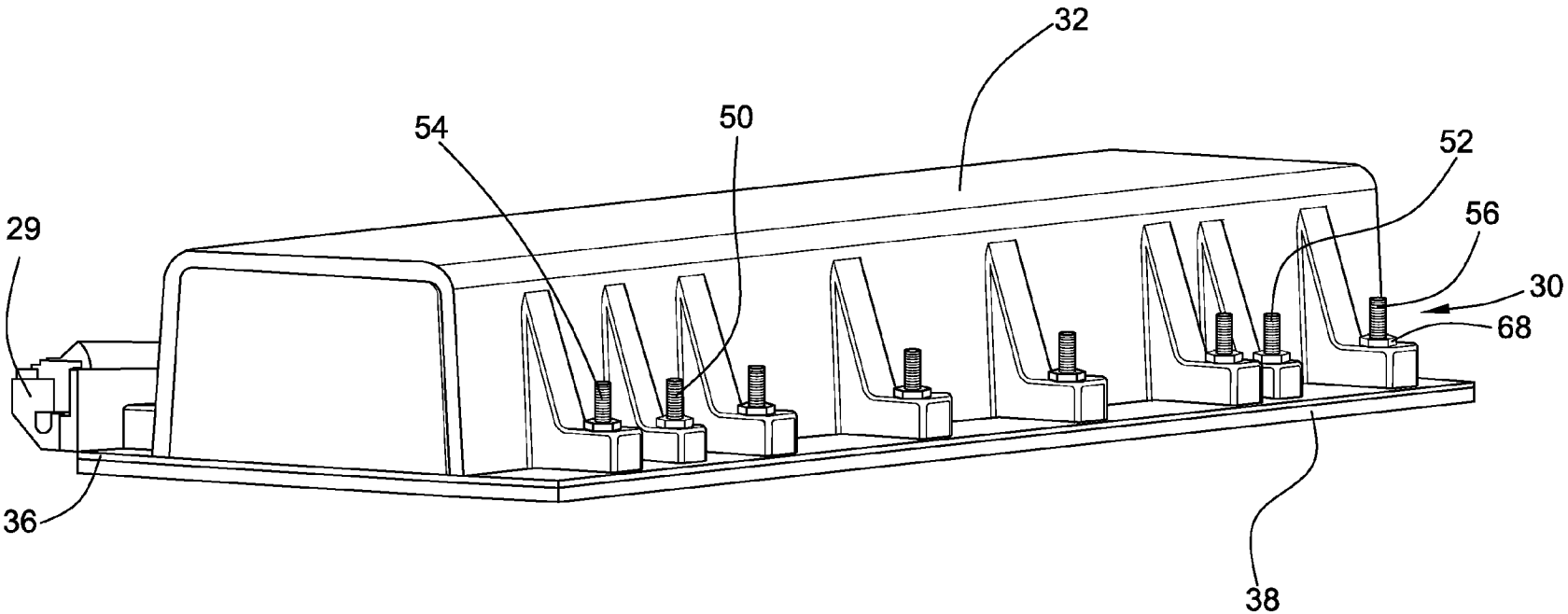
FIG. 3 is an enlarged isometric view of a screed plate assembly constructed in accordance with teachings of this disclosure.
Figure 4:
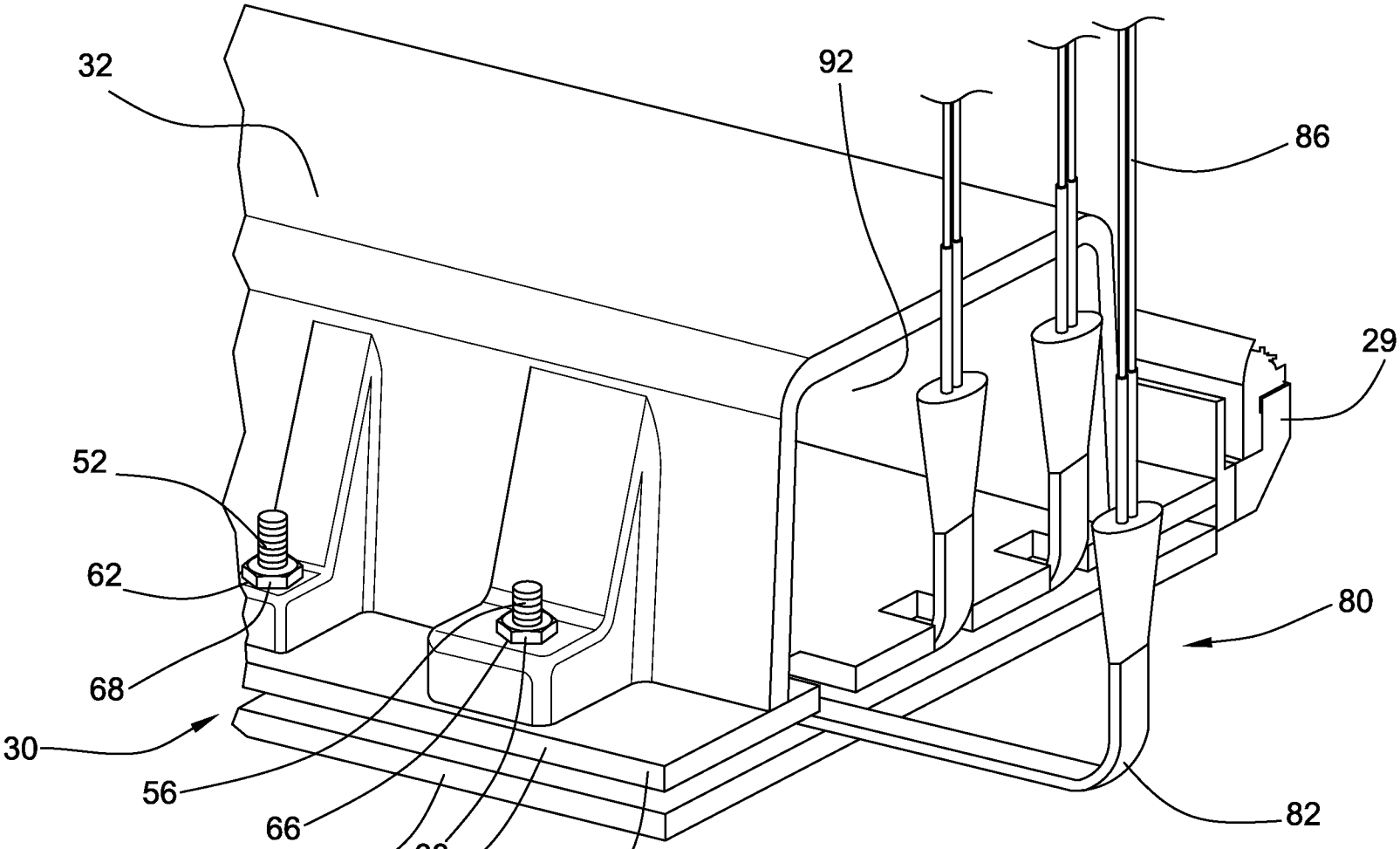
FIG. 4 is a further enlarged fragmentary isometric view of the screed plate assembly of FIG. 3 with an end plate removed, and with the lower screed plate 38 displaced from the upper screed plate 36 and the screed supporting frame portion.
Figure 5:
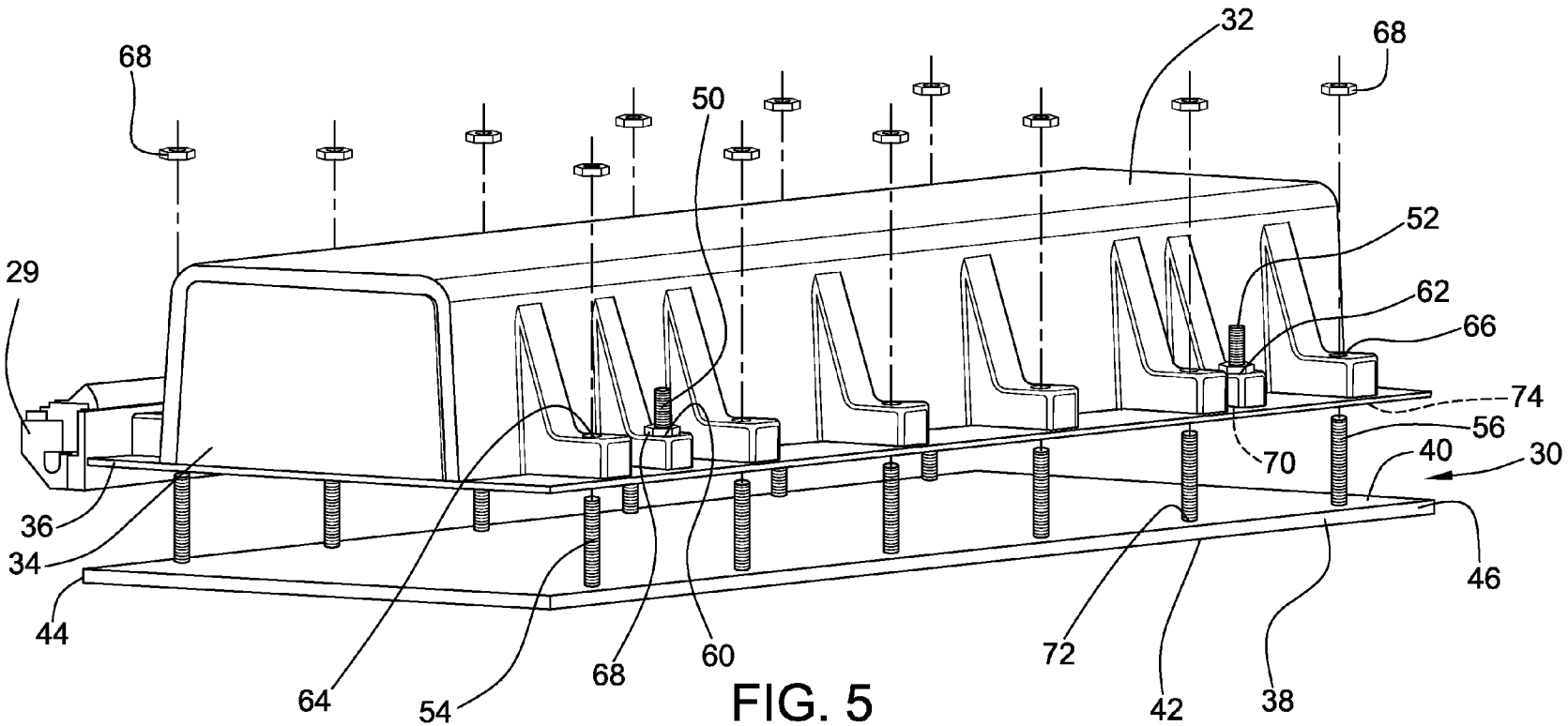
FIG. 5 is an enlarged isometric view of the screed plate assemblies of FIGS. 3 and 4 with the lower screed plate 38 removed from the screed supporting frame portion.

Turning to FIGS. 3-5, each of the screed sections 22, 24, 28 includes at least one screed plate assembly 30 that is removably connected to and supported by a screed supporting frame portion 32. The ends of the screed plate assembly 30 and screed supporting frame portion 32 may be reinforced by end plates 34.

The screed plate assembly 30 includes an upper screed plate 36 and a lower screed plate 38, both of which are coupled to the screed supporting frame portion 32. The lower screed plate 38 is an elongated largely flat metal plate having an upper surface 40 and a lower surface 42 positioned between a leading edge 44 and the trailing edge 46. In the illustrated embodiment, the upper screed plate 36 is likewise a largely flat structure, although it may be of an alternate configuration so long as the upper and lower screed plates 36, 38 are coupled to the screed supporting frame portion 32 as described herein.

According to a feature of the disclosed screed plate assembly 30, the upper screed plate 36 is coupled to the screed supporting frame portion 32 independently of the lower screed plate 38. In this way, as illustrated in FIGS. 4 and 5, the lower screed plate 38 may be displaced from the screed supporting frame portion 32 for service, repair, or replacement, while the upper screed plate 36 remains in position on the screed supporting frame portion 32. For the purposes of this disclosure, the term "displaced" shall include both completely removing the lower screed plate 38 from the screed supporting frame portion 32, and merely spacing the lower screed plate 38 from the upper screed plate 36 and the screed supporting frame portion 32, as shown, for example, in FIGS. 5 and 4, respectively.

The upper screed plate 36 is coupled to the screed supporting frame portion 32 by at least two connectors 50, 52, and the lower screed plate 38 is coupled to the screed supporting frame portion 32 by at least two connectors 54, 56. While any appropriate connecting arrangement may be utilized, in the illustrated embodiment, the screed supporting frame portion 32 includes a plurality of bores 60, 62, 64, 66 through which connectors 50, 52, 54, 56 from the upper and lower screed plates 36, 38 extend. More specifically, connectors 50, 52 extend from the upper screed plate 36 through first bores 60, 62 in the screed supporting frame portion 32, and connectors 54, 56 from the lower screed plate 38 extend through the second bores 64, 66 of the screed supporting frame portion 32.

The connectors 50, 52, 54, 56 may be of any appropriate design. By way of example only, the connectors 50, 52, 54, 56 may be threaded fasteners, as illustrated, which are received by locking nuts 68. It will be appreciated that the connectors 50, 52, 54, 56 may extend through openings 70, 72 in the upper and lower screed plates 36, 38, or they may be otherwise secured to the upper and lower screed plates 36, 38. For example, they may be secured in openings 70, 72 in the form of recesses in the upper and lower screed plates 36, 38. In this way, the term "openings" is intended to include both bores that extend completely through the upper and lower screed plates 36, 38, as well as recesses that extend only partway through the thickness of the upper and lower screed plates 36, 38.

The upper screed plate 36 may include openings 74 that allow for passage of the connectors 54, 56 extending from the lower screed plate 38 toward the screed supporting frame portion 32. The openings 74 may be of any appropriate design. For example, the openings 74 may be generally round or they may be slots (not shown) that extend from the sides surfaces 76 of the upper screed plate 36 to accommodate passage of the connectors 54, 56.

Each screed plate assembly 30 is heated by a screed heating arrangement 80. The screed heating arrangement 80 includes at least one electric heater 82 positioned to heat at least the lower screed plate 38. A greater number electric heaters 82 may be provided for each screed plate assembly 30, as shown, for example, in FIGS. 3-5. The length and number of each electric heater 82 varies depending on the length the screed plate assembly 30 for each screed section 22, 24, 28.

Each electric heater 82 is connected to an electric power supply 88, shown in FIG. 1. One suitable electric power supply 88 for the practice of the present invention is an electric generator 90, with the output connections of the electrical generator 90 being connected to the leads 86 of a corresponding electric heater 82. The electrical generator 90 is operatively connected to the engine 16 of the asphalt paving machine 10, such as by direct connection or powered by a hydraulic motor (not shown). The generator 90 may be either an AC or DC generator such as a 12 or 24 volt DC or 110 or 240 AC generator.

Any appropriate design of electric heater 82 may be utilized. The electric heater 82 in the illustrated embodiment is configured as a thin, elongate sheet or ribbon and formed from a resistive conductor, e.g., a thin conductive wire or ribbon. It will be appreciated, however, that alternate designs of electric heaters 82 may be utilized, such as, electric heaters 82 that present a broader profile. A resistive conductor within each electric heater 82 terminates with a set of leads 86 or electrical conductors that protrude from the electric heater 82.

In the illustrated embodiment, the electric heater 82 is sandwiched between the upper and lower screed plates 36, 38. Consequently, displacing the lower screed plate 38 from the upper screed plate 36 and the screed supporting frame portion 32, as shown in FIGS. 4 and 5, provides access to the electric heater 82 for repair or replacement. Depending upon the design of the electric heater 82 and the upper and lower screed plates 36, 38, the electric heater 82 may be slid out from between the upper and lower screed plates 36, 38, and a new or repaired electric heater 82 slid back into position.

The upper and lower screed plates 36, 38 may be made of any appropriate material. By way of example only, the lower screed plate 38 may be constructed of a high wear steel, while the upper screed plate 36 may be formed of steel, a ferrous material, or composite insulating material. For example, the upper screed plate 36 may be formed of a material which assists in conducting heat from the electric heater 82 to the lower screed plate 38 to enhance heating of the lower screed plate 38. Alternatively or additionally, the upper screed plate 36 may be formed of a material that provides an insulative effect, which may minimize heat loss from the electric heater 82 and the lower screed plate 38.

Returning to FIG. 3, respective layers of insulation material (not illustrated) may be positioned to cover each electric heater 82 to reduce loss of heat from the heater 82 and more effectively transfer the heat to the lower screed plate 38. If desired, such a layer of insulation material may be secured in place by any appropriate means, such as, for example, a plurality of straps (not illustrated). In the illustrated embodiment, for example, a channel 92 is formed between the screed supporting frame portion 32 and the upper screed plate 36 which may receive such insulation. Alternatively or additionally, an insulation blanket (not illustrated) may be provided along the top surface of the screed supporting frame portion 32.

INDUSTRIAL APPLICABILITY

The present disclosure is applicable to screed plate assemblies 30 and their attachment to asphalt paving machines 10. The screed plate assembly 30 including upper and lower screed plates 36, 38 may reduce the time associated with repair or replacement of the lower screed plate 38 or the electric heater 82. In some embodiments, when the lower screed plate 38 is displaced from the upper screed plate 36 and the screed supporting frame portion 32, the electric heater 82 may be simply slid out from between the upper and lower screed plates 36, 38. A replacement electric heater 82 may then be slid back into position before the lower screed plate 38 is again moved toward the upper screed plate 36 and the screed supporting frame portion 32.

Maintaining the mounted upper screed plate 36 in position while displacing the lower screed plate 38 from the upper screed plate 36 and the screed supporting frame portion 32 may reduce or eliminate entirely the time associated with calibrating attachment of the screed plate assembly 30 to the screed supporting frame portion 32, that is, the screed plate assembly 30 generally will not require the complete shimming process typically associated with mounting of a screed plate assembly 30.

Placement of the electric heater 82 between the upper and lower screed plates 36, 38 may enhance efficiency of the heating arrangement 80. Heating of the lower screed plate 38 may be improved by way of enhanced conduction of heat from the electric heater 82 to the lower screed plate 38, or by enhancing the consistency of heat transmitted to the lower surface 42 of the lower screed plate 38.

In some embodiments, placement of the electric heater 82 between the upper and lower screed plates 36, 38 may leave the upper surface of the upper screed plate 36 for placement of additional insulating blankets, or mounting a vibration pod directly to the screed plate assembly 30.

During operation of the asphalt paving machine 10, the electric heater 82 flexes with the screed plate assembly 30 as the paving machine 10 traverses the road bed were asphalt paving material is being laid. When a thin design of the electric heater 82 is utilized, the placement of the electric heater 82 between the upper and lower screed plates 36, 38 may act to minimize stresses on the electric heater 82.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An asphalt paving machine comprising a screed assembly including a screed supporting frame portion having at least two first bores and at least two second bores, a screed plate assembly including at least one lower screed plate having at least two openings, at least one upper screed plate having at least two openings, at least one electric heater at least partially disposed between the upper and lower screed plates, at least two lower plate connectors extending into the at least two openings of the lower screed plate and the at least two first bores of the screed supporting frame portion to couple the lower screed plate to the screed supporting frame portion, at least two upper plate connectors extending into the at least two openings of the upper screed plate and the at least two second bores of the screed supporting frame portion to couple the upper screed plate to the screed supporting frame portion independently of the lower screed plate, the lower and upper screed plates being in direct contact at least proximal the at least two openings of the lower screed plate and the at least two openings of the upper screed plate, the lower screed plate being displaceable from direct contact with the upper screed plate and from the screed supporting frame portion by loosening the at least two lower plate connectors.

2. The asphalt paving machine of claim 1 wherein the upper screed plate includes at least two additional openings, and the at least two lower plate connectors extending into the at least two openings of the lower screed plate, through the at least two additional openings of the upper screed plate, and into the at least two first bores of the screed supporting frame portion to couple the lower screed plate to the screed supporting frame portion.

3. The asphalt paving machine of claim 1 wherein the lower plate connectors are threaded connectors.

4. The asphalt paving machine of claim 1 wherein a plurality of electric heaters are disposed between the upper and lower screed plates.

5. The asphalt paving machine of claim 1 wherein the upper screed plate is formed of a composite material.

6. The asphalt paving machine of claim 1 further including an insulation material.

7. The asphalt paving machine of claim 5 wherein the upper screed plate includes an insulating material.

8. The asphalt paving machine of claim 1 wherein the upper screed plate is formed of a material exhibiting good thermal conductivity.

9. The asphalt paving machine of claim 1 wherein the electric heater is adapted to be separated from the upper screed plate when the lower plate connectors are loosened and the lower screed plate is separated from the upper screed plate.

10. The asphalt paving machine of claim 1 wherein the at least one electric heater is adapted to be slid from between the upper and lower screed plates when the lower plate connectors are loosened.

11. The asphalt paving machine of claim 1 wherein the lower screed plate is displaceable from the upper screed plate and the screed supporting frame portion, but wherein the lower screed plate is still coupled to the screed supporting frame portion by said lower plate connectors.

12. A screed plate assembly for attachment to a screed supporting frame portion of an asphalt paving machine, the screed supporting frame portion having at least two first bores and at least two second bores, the assembly comprising:

at least one lower screed plate having an upper surface and at least two openings, at least one upper screed plate having a lower surface and at least two openings, at least one electric heater at least partially disposed between the upper and lower screed plates, at least two lower plate connectors adapted to extend into the at least two openings of the lower screed plate and the at least two first bores of the screed supporting frame portion to couple the lower screed plate to the screed supporting frame portion, at least two upper plate connectors adapted to extend into the at least two openings of the upper screed plate and the at least two second bores of the screed supporting frame portion to couple the upper screed plate to the screed supporting frame portion independently of the lower screed plate, the lower and upper screed plates being in direct contact over a majority of the upper and lower surfaces including at least proximal the at least two openings of the lower screed plate and the at least two openings of the upper screed plate, the lower screed plate being displaceable from direct contact with the upper screed plate and from the screed supporting frame portion by loosening the at least two lower plate connectors.

13. A method of attaching a screed plate assembly to a screed assembly of an asphalt paving machine, the screed assembly including a screed supporting frame portion, the method comprising:

providing at least two first bores and at least two second bores in the screed supporting frame portion, providing a screed plate assembly including at least one lower screed plate having at least two openings, at least one upper screed plate having at least two openings, and at least one electric heater disposed between the upper and lower screed plates, extending at least two upper plate connectors into the at least two openings of the upper screed plate and the at least two second bores of the screed supporting frame portion to secure the upper screed plate to the screed supporting frame portion, and extending at least two lower plate connectors into the at least two openings of the lower screed plate and the at least two first bores of the screed supporting frame portion to secure the lower screed plate to the screed supporting frame portion with the lower screed plate in direct contact with the upper screed plate at least proximal the at least two openings of the upper screed plate and at least two openings of the lower screed plate, the at least two upper plate connectors securing the upper screed plate to the screed supporting frame portion independently of the lower screed plate.

14. The method of claim 13 further including the step of loosening the at least two lower plate connectors and displacing the lower plate from the upper screed plate and the screed supporting frame portion while maintaining the upper screed plate secured to the screed supporting frame portion.

15. The method of claim 14 further including removing the at least one electric heater from between the upper and lower screed plates.

16. The method of claim 15 further including disposing at least one replacement electric heater between the upper and lower screed plates and securing the lower screed plate to the screed supporting frame portion.

17. The method of claim 14 wherein the step of loosening the at least two lower plate connectors includes displacing the lower screed plate downward to space the lower screed plate from the upper screed plate, but not removing the lower screed plate entirely from the asphalt paving machine.

18. The method of claim 14 further including entirely removing the lower screed plate from the screed supporting frame portion.

19. The method of claim 18 further including attaching a replacement lower screed plate to the screed supporting frame portion.

20. The method of claim 19 further including disposing the lower and upper screed plates in direct contact over a majority of the upper and lower surfaces including at least proximal the at least two openings of the lower screed plate and the at least two openings of the upper screed plate.

* * * * *